US005415399A

United States Patent [19]

Kettelson

[11] Patent Number: 5,415,399

[45] Date of Patent: May 16, 1995

[54] GOLF PUTTER CONSTRUCTION

[75] Inventor: Russell W. Kettelson, Waterford, Mich.

[73] Assignee: Nicholas J. Marinelli, Franklin, Mich. ; a part interest

[21] Appl. No.: 182,236

[22] Filed: Jan. 18, 1994

[51] Int. Cl.[6] ..... A63B 53/02; A63B 53/16

[52] U.S. Cl. ..... 273/81.2; 273/80 C; 273/80 D; 273/80.1; 273/80.2; 273/81.3; 273/167 G; 273/169

[58] Field of Search ..... 273/167 R, 167 G, 79, 273/80 R, 80 C, 80 D, 80.1, 80.2, 80.3, 80.8, 81 C, 81 D, 81.2, 81.3, 168, 169

[56] References Cited

U.S. PATENT DOCUMENTS

| | | | |
|---|---|---|---|
| 1,599,336 | 9/1926 | Lindgren | 273/79 |
| 1,643,250 | 9/1927 | Longsworth | 273/79 |
| 2,155,830 | 4/1939 | Howard | 273/79 |
| 2,530,446 | 11/1950 | Beardsley | 273/79 |
| 4,736,951 | 4/1988 | Grant | 273/79 |
| 4,815,740 | 3/1989 | Williams et al. | 273/80.1 |
| 5,029,860 | 7/1991 | Ehrich | 273/81.2 |
| 5,083,779 | 1/1992 | Ungermann | 273/79 |

*Primary Examiner*—William H. Grieb
*Attorney, Agent, or Firm*—Charles W. Chandler

[57] ABSTRACT

A golf putter having a head with an opening. The lower end of the putter's shaft has a bushing received in the opening. A slug having a multi-faced mid-section is received in a central opening in the bushing. The slug has shoulders connected to the head in such a way that the angle of the shaft with respect to the head depends upon the slug configuration. One version employs a club head with a longitudinal channel for supporting the lower end of the shaft in an adjusted position. The shoulders on the slug that seat in the sides of the channel. Another version employs a club head with a back opening for receiving the slug. The shaft has a pair of telescopically connected sections that can be incrementally adjusted to change the shaft length. An auxiliary shaft can be added to increase the overall length of the shaft.

15 Claims, 4 Drawing Sheets

GOLF PUTTER CONSTRUCTION

BACKGROUND OF THE INVENTION

This invention is related to golf putters having first structure for adjusting the angle of the shaft with respect to the head, and more particularly to such a putter having interchangeable slugs for connecting the shaft in a selected angle with the ground-engaging portion of the head, and second structure for adjusting the shaft length. All adjustments can be made quickly with no need for tools.

Frequently, golfers desire to adjust both the angle of a putter shaft to the ground-engaging portion of the head, and the shaft length to accommodate differences in putting style, or anatomical differences between users.

Some prior art adjustable golf clubs may be found in U.S. Pat. No. 1,643,250, which was issued Sep. 20, 1927, to Ralph N. Longsworth for "Adjustable Golf Club Head"; U.S. Pat. No. 4,736,951, which was issued Apr. 12, 1988, to Thomas Grant for "Golf Club"; U.S. Pat. No. 2,155,830, which was issued Apr. 25, 1939 to John J. Howard for "Golf Club"; and U.S. Pat. No. 4,815,740, which was issued Mar. 28, 1989 to Joseph Williams and Joseph L. La Mura for "Adjustable Golf Club".

Other golf clubs having adjustable features may be found in U.S. Pat. No. 1,599,336, which was issued Sep. 7, 1926, to Walfred Lindgren for "Golf Club"; and U.S. Pat. No. 2,530,446, which was issued Nov. 21, 1950 to John A. Beardsley for "Combination Golf Club".

SUMMARY OF THE INVENTION

The broad purpose of the present invention is to provide an improved adjustable golf club comprising relatively few parts that may be easily adjusted to change the angle between the club shaft and the head of the club. The shaft length can be adjusted to accommodate the shaft angle.

The preferred embodiment of the invention employs a head having a longitudinal, open-top channel. The shaft has a bushing which is received in the channel.

The bushing preferably has a hexagonal opening formed about an axis that is generally at right angles to the striking surface of the putter. The opening could also be internally splined or serrated. A slug having a hexagonal mid-section is received in the bushing. The slug has a pair of shoulders received in horizontal slots on opposite sides of the channel. A flat spring in the bottom of the channel urges the bushing and the slug toward the upper sides of the slots. A single or a pair of weights can be mounted either at one end or at opposite ends of the channel. The weights can be connected to the ends of one spring, or engaged with a pair of springs. The springs urge the weights toward the upper sides of the slots. Thus the bushing and the lower end of the shaft are held in a fixed angular position with respect to the club head.

The user can change the angle of the shaft with respect to the head by replacing the slug with another slug having a hexagonal mid-section rotated some degree from the position of the first slug.

The user can also change the longitudinal position of the shaft with respect to the head of the club.

The overall length of the shaft can be increased or reduced to accommodate a change in the shaft angle or anatomical differences between users. The shaft has a pair of telescopic sections that can be adjusted to provide an incremental change in the shaft length, or a third section of shaft can be added to the top of the telescopic shafts to form a longer combined shaft.

Another embodiment of the invention employs a club head having a top opening for receiving a bushing carried on the lower end of the shaft. The back face of the club also has an opening for receiving a slug having an inner portion that is received in the opening of the bushing, and an outer portion that is received in the matching opening in the back face of the club head. The preferred hexagonal (or splined, serrated, etc.) portions of the slug mate with similar hexagon openings in the bushing and the club head to permit the user to select the particular angle that he desires the shaft to take with respect to the head.

Still further objects and advantages of the invention will become readily apparent to those skilled in the art to which the invention pertains upon reference to the following detailed description.

DESCRIPTION OF THE PREFERRED EMBODIMENT

Figure 1:
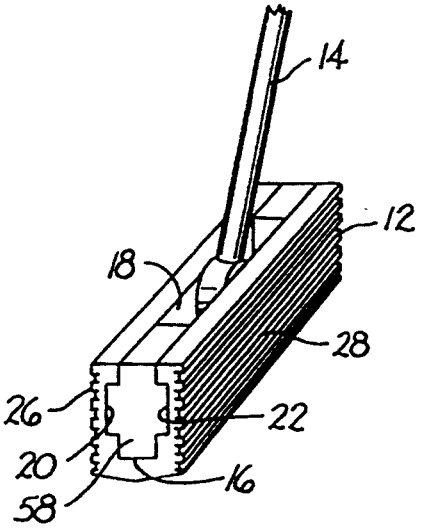
FIG. 1 is a perspective view of an adjustable putter illustrating the preferred embodiment of the invention.
Figure 2:
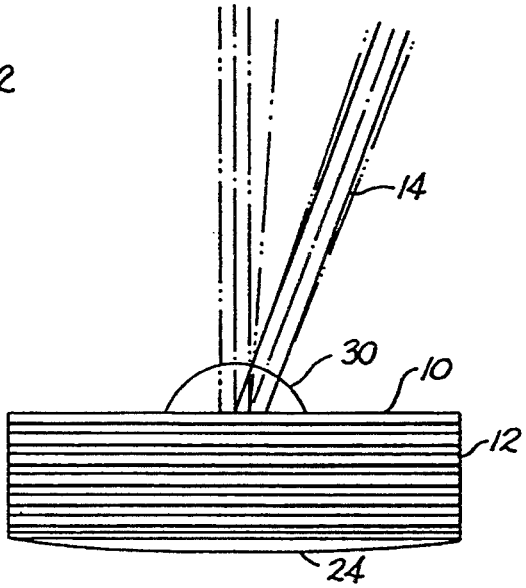
FIG. 2 is a view illustrating the range of the adjustment of the shaft with respect to the putter head.
Figure 3:
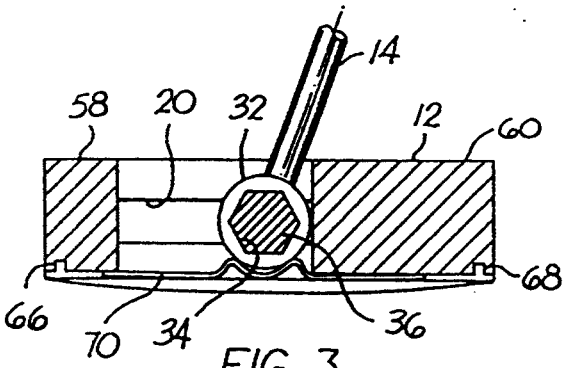
FIG. 3 is a longitudinal sectional view of the club of FIG. 1.

Referring to the drawings, a preferred putter 10, illustrated in FIGS. 1 through 3, comprises a head 12 and a shaft 14. Head 12 has an elongated body with an internal longitudinal channel 16 with open top 18. Channel 16 has a pair of internal, opposed longitudinal slots 20 and 22.

The head has a bottom ground-engaging surface 24, and generally planar, vertical, ball-striking surfaces 26 and 28. Surfaces 26 and 28 are illustrated as having longitudinal, horizontal grooves, however, these surfaces may have other surface configurations suitable for putting a ball outlined at 30 in FIG. 2.

Surfaces 26 and 28 do not both have to be putting surfaces. One of the two can be the backside of the putter.

The lower end of shaft 14, as best illustrated in FIG. 3, carries bushing 32. The bushing preferably has a hexagonal internal opening 34, and is received between internal slots 20 and 22 of the channel.

Figure 6:
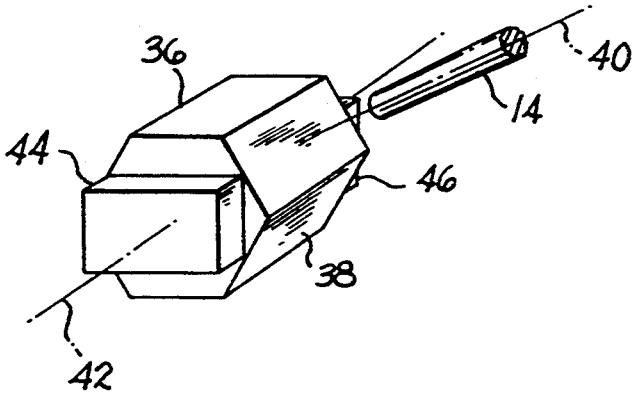
FIGS. 6 and 7 are views of alternative slugs and their relationship with the shaft.

Referring to FIGS. 3 and 6, slug 36 has a hexagonal midsection 38 slidably received in hexagonal opening 34 of the bushing. Thus the angular relationship of the longitudinal axis 40 of shaft 14 is fixed with respect to axis 42 of the slug. Axis 42 of the slug is disposed generally horizontal and perpendicular to ball-striking surface 28 of the putter. Axis 42 is also transverse to shaft axis 40.

The slug has a pair of outer, similarly shaped shoulders 44 and 46 on opposite sides of the hexagonal midsection. Shoulders 44 and 46 are slidably received in slots 22 and 20, respectively, of the channel to prevent slug rotation with respect to the putter head.

Figure 7:
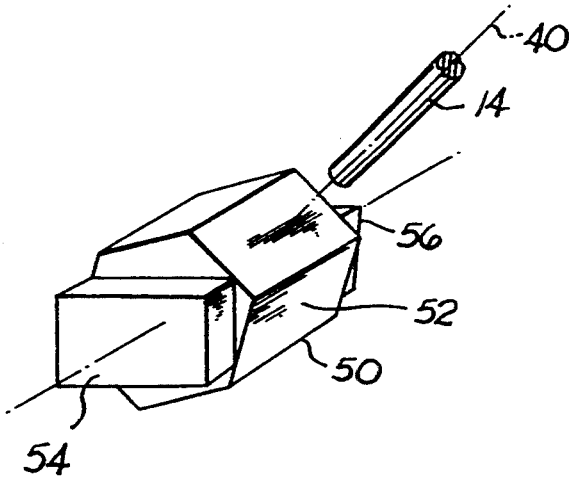

FIG. 7 illustrates an alternative slug 50 having a hexagonal mid-section 52 slidably receivable in the bushing opening. Slug 50 also has a pair of shoulders 54 and 56 that are slidably receivable in slots 22 and 20 of the putter body channel. The angular relationship between shoulders 54 and 56 and the hexagonal profile of the mid-section of the slug is rotated some degree counterclockwise, as viewed in FIG. 7, with respect to the relationship of these components illustrated in FIG. 6. This relationship can be changed by exchanging slug 50 for slug 36. Other slugs having their hexagonal profile rotated a few more degrees with respect to the shoulders may also be used.

Figure 4:
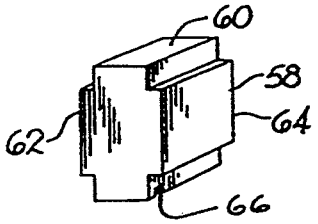
FIG. 4 is a view of a illustrative weight.

A pair of metal weights 58 and 60, are mounted at opposite ends of the putter head channel. Each weight has a cross section as shown in FIG. 4, that is, with a rectangular mid-section 60, and a pair of lateral shoulders 62 and 64 slidably received in slots 20 and 22, respectively. Each weight has a bottom surface spaced above the bottom of the channel. Forward weight 58 has a small transverse bottom-facing slot 66, and rearward weight 60 has a small transverse bottom-facing slot 68. The shaft bushing is mounted between the two weights, via either a common flat spring 70 or an independent spring 70A in FIG. 5A.

Figure 5:
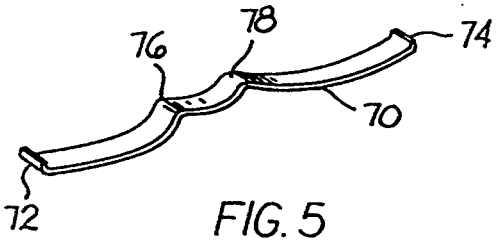
FIG. 5 is a perspective view of the retaining common spring.

Referring to FIG. 5, an elongated common leaf spring 70 is mounted in the bottom of the channel. One end 72 is slightly turned up and received in slot 66 of the forward weight and its opposite end 74 is also slightly turned up and received in slot 68 of the rearward weight. The width of the spring is slightly less than the width of the bottom of the channel.

The mid-section of the spring has a pair of longitudinally spaced, generally inverted V-shaped shoulders 76 and 78 which extend up from the bottom of the channel. The distance between the two shoulders is less than the diameter of the bushing. The bushing is seated on the two shoulders.

The length of spring 70 between end 72 and shoulder 76 is bowed downwardly as illustrated in FIG. 5. Similarly the length of the spring between ends 74 and shoulder 78 is bowed downwardly, that is in the opposite direction from the upturned ends. The bowed spring lengths are resilient to urge the shaft bushing and the weights upwardly against the top sides of slots 20 and 22, thereby resiliently retaining the bushing in position in the putter head. Further, the weights frictionally engage the slot surfaces to prevent longitudinal motion of the spring.

To assemble the putter components, forward weight 58 engages the forward edge of the leaf spring. The leaf spring and weight 58 are inserted through the rear or right end of the channel as viewed in FIG. 3. The shaft bushing with the slug inserted is seated on shoulders 76 and 78 and introduced into the channel. The rear weight 60 is then engaged with spring end 74 and inserted in the channel. The components are then moved forward in the channel until weight 58 is flush with the forward end of the putter body, and the rearward weight is flush with the rear end of the putter body.

Figure 5A:
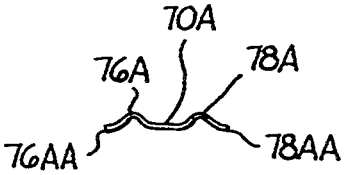
FIG. 5A is a perspective view of the independent shaft bushing retaining spring.

FIG. 5A illustrates an alternative spring 70A which is shorter than spring 70. Spring 70A is not connected to the two weights, but has a pair of spaced shoulders 76A and 78A which support the bushing. The ends 76AA and 78AA of this spring engage the bottom of the channel and are offset from the shoulders a sufficient distance so as to resiliently push the slug shoulders against the top sides of slots 20 and 22.

Figure 5B:
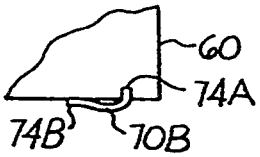
FIG. 5B is a perspective view of the independent weight retaining spring.

FIG. 5B shows still another spring 70B which is also bowed but with an upturned end 74A received in transverse slot 68 of the weight. The opposite ends 74B engage the bottom of the weight so that the spring urges the shoulders of the weight towards the top side of slots 20 and 22.

Thus, I have described an embodiment of the invention in which the angle of the shaft with respect to the putter head can be adjusted by exchanging the slug for another slug having a midsection rotated a few degrees with respect to the shaft axis.

Figure 11:
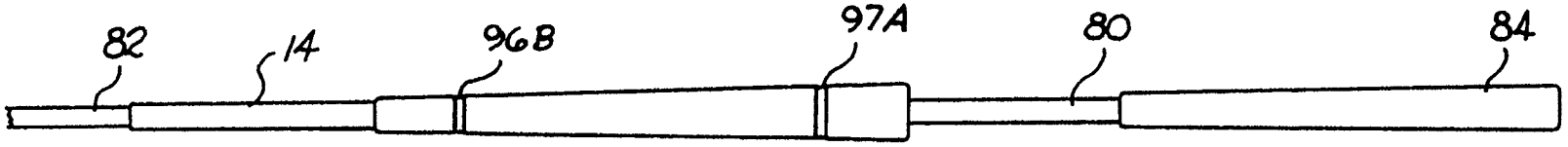
FIG. 11 is a fragmentary view of the shaft.
Figure 12:
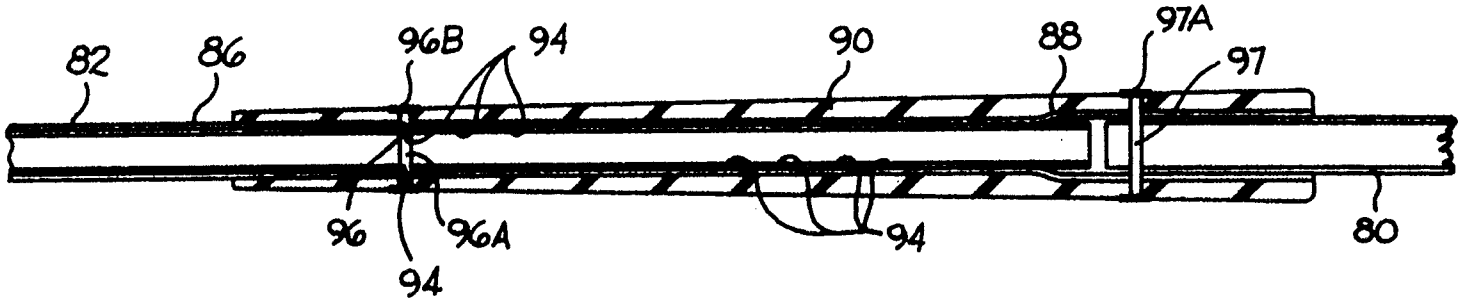
FIG. 12 is an enlarged sectional view of the sleeve joining the upper and lower ends of the shaft.

Referring to FIGS. 11 and 12, shaft 14 comprises an auxiliary upper tubular shaft end 80 and a primary lower tubular shaft end 82. Upper shaft end 80 preferably has a slightly greater diameter than lower shaft end 82. A conventional outer rubber-like grip 84 is mounted on the upper shaft end 80. An inner tubular sleeve 86 has a lower end telescopically slidably receiving lower end shaft 82, and its upper end slightly flared at 88 to telescopically receive upper shaft end 80.

A primary outer rubber-like grip 90 is mounted on sleeve 86. Thus the upper and lower grips provide means for permitting the golfer to putt using a hand arrangement in which his two hands are spaced relatively far apart.

The upper end of lower shaft 82 has 13 aligned pairs of regularly spaced openings 94. Sleeve 86 has a pair of aligned openings 96 which can be aligned with any of the 13 pairs of openings 94 of the lower shaft 82 for length adjustment. Pin 96A is inserted in a selected pair of aligned openings to fasten the sleeve and the lower shaft together. Rubber band 96B is wrapped around sleeve 90 in a groove to locate the ends of pin 96A. Thus, the overall length of the shaft can be incrementally adjusted depending upon which pairs of openings 94 are aligned with openings 96.

A second pin 97 connects the flared end of shaft 14 to auxiliary shaft 80. A second rubber band 97A is wrapped around primary grip 90 so as to engage the opposite ends of pin 97 in a groove to resiliently retain the pin in position.

This arrangement permits the user to incrementally adjust the overall length of the putter shaft after he has selected the particular shaft to head angle he desires. Further, the user can increase the overall length of the shaft by adding auxiliary shaft 80.

Figure 8:
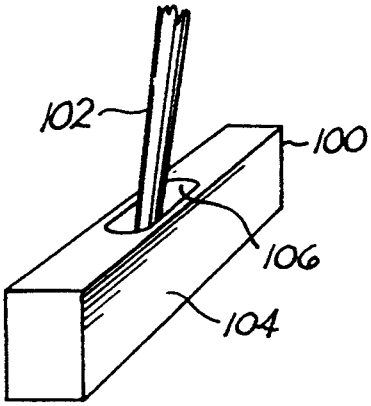
FIG. 8 is a view of another embodiment of the invention.
Figure 9:
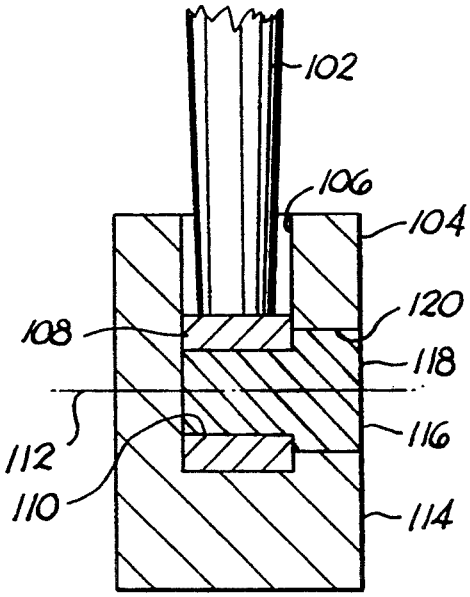
FIG. 9 is a transverse sectional view through the embodiment of FIG. 8.
Figure 10:
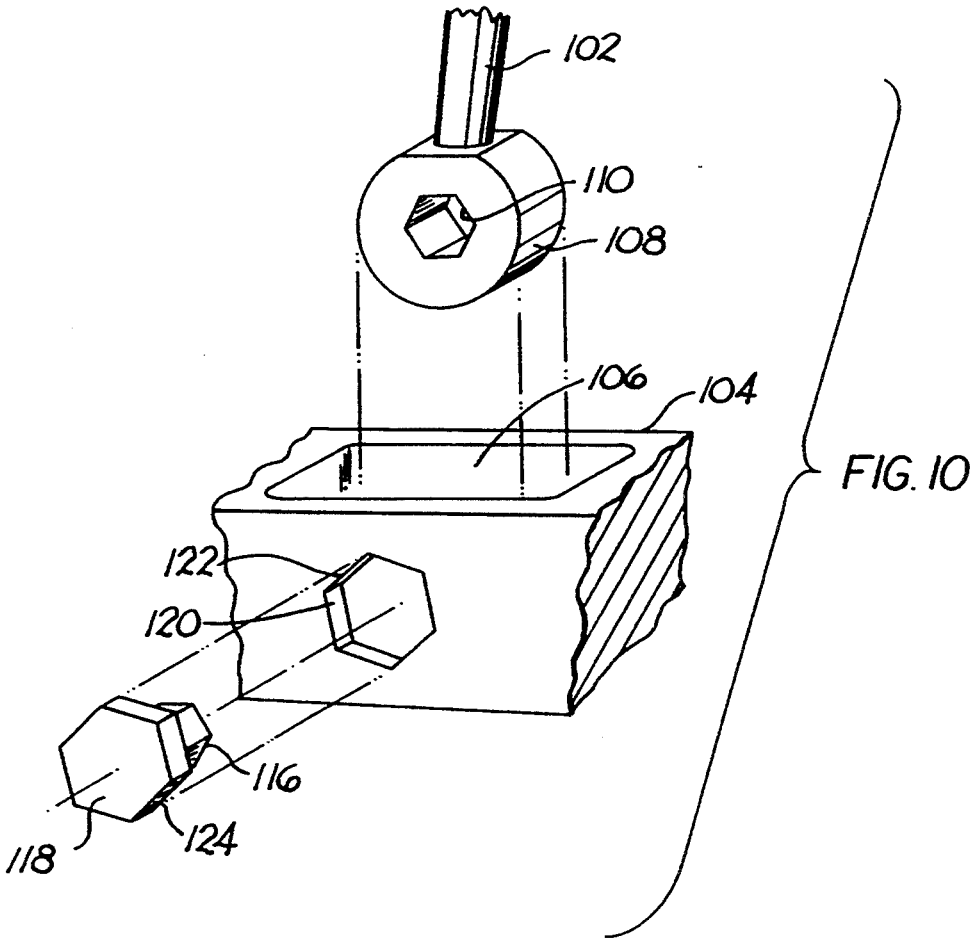
FIG. 10 is an exploded view of the embodiment of FIG. 8.

FIGS. 8–10 illustrate another embodiment of the invention in the form of putter 100 which has a shaft 102 and a putter head 104. Putter head 104 has a top opening 106. The lower end of the shaft carries a bushing 108 which is receivable in opening 106. Bushing 108 has an internal opening 110 formed about a horizontal axis 112 which is generally perpendicular to the ball-striking vertical surface 114 of the putter head. Bushing opening 110 preferably has an internal hexagon shape. Other internal configurations can be employed for the multi-sided shape of the bushing opening such as a spline, a square, and the like so long as the shape is complementary with the external multi-sided end 116 of slug 118.

Slug end 116 preferably has a hexagonal shape slidably engageable with the hexagon opening of the bushing so that the bushing and the slug slidably mate together. The particular angular position of the slug in the putter head is adjusted depending upon how the bushing is received into the bushing opening.

Referring to FIG. 10, the back face of the putter head has an opening 120, also formed with hexagon shape 122. The diameter of opening 120 is greater than the diameter of bushing opening 110. The slug has an enlarged outer head 124 with a hexagon shape slidably fitted with hexagon shape 122 of opening 120.

The putter components are assembled by inserting bushing 108 through top opening 106 until bushing opening 110 is aligned with putter head opening 120. When the shaft has been located at the desired angle with respect to the putter head, the slug is inserted so that inner end 116 mates with bushing opening 110. The slug head 124 is mated in opening 120 with a relatively tight fit to lock the shaft to the head. The larger outer end of the slug can extend beyond the back face of the putter or have other grasping means so that the user can grasp it to readjust the angle of the shaft by changing to another slug.

Having described my invention, I claim:

1. A golf club, comprising:

a club head having a first opening, a generally planar ball-striking surface, and a ground-engaging surface, a slug removably disposed in the first opening in a first adjusted position so as to be movable with the club head; and a shaft having a lower end with a slug-receiving opening receiving the slug so as to be connected to the head in a first shaft angle with respect to the ground-engaging surface, and being movable with respect to the slug so as to be disposed in a second shaft angle with respect to the ground-engaging surface of the club head.

2. A golf club as defined in claim 1, in which the slug is interchangeable to allow additional adjusted positions with respect to the club head, and the shaft is connected to the slug in another shaft angle.

3. A golf club as defined in claim 2, in which the slug is interchangeable between a first slug position and additional slug positions about an axis generally perpendicular to the ball-striking surface.

4. A golf club as defined in claim 1, in which the slug has a multi-sided surface structure, and the club head has a complementary structure for selectably engaging the surface structure of the slug to accommodate a selected angle of the shaft with respect to the ground-engaging surface of the club head.

5. A golf club as defined in claim 1, including a bushing structure carried on the lower end of the shaft, the bushing structure having an opening with an interlocking shape, and the slug has structure slidably receivable in the bushing structure opening to engage the bushing opening in a position accommodating a selected angle of the shaft with respect to the ground-engaging surface of the club head.

6. A golf club, comprising:

a shaft having a lower end with bushing structure having a slug-receiving opening;

a club head having an open top channel, a generally planar, ball-striking surface, and a ground-engaging surface;

a first slug removably disposed in said channel, and received in said slug receiving opening to connect the head and the slug to the shaft in a first adjusted position;

a second slug receivable in said channel and in said slug receiving opening, for connecting the shaft to the club head in a second adjusted position of the shaft with respect to the head;

each of said slugs having a first portion thereof receivable in a locked position in the slug receiving opening, and a second portion extending beyond said slug receiving opening, and the club head having locking means for receiving the second portion of each of the slugs in a non-rotatable positioning in the club head.

7. A golf club as defined in claim 6, in which the locking means in the head includes an elongated spring having a pair of legs slidably received in the channel, and engageable with the bushing structure to retain same in the channel.

8. A golf club as defined in claim 7, including a pair of weight means disposed in the channel on opposite sides of the bushing structure and engaging the elongated spring whereby the spring retains the pair of weights in a relatively fixed position in the head.

9. An extendable shaft for a golf club, comprising a lower tubular shaped member, an upper tubular shaft member;

a sleeve having a lower end telescopically receiving the lower shaft member and an upper end telescopically receiving the upper shaft member;

locking means connecting the sleeve to one of the shaft members;

the other of the shaft members having a plurality of longitudinally spaced aligned openings; and pin means mounted on the sleeve receivable into a selected pair of said aligned openings to connect the sleeve to said one of the shaft members whereby the overall length of the upper shaft member and the lower shaft member can be adjusted.

10. An extendable shaft as defined in claim 9, including a first gripping member mounted over the sleeve and a second gripping member mounted over the upper shaft member.

11. An extendable shaft as defined in claim 9, in which the locking means comprises a second pin means.

12. A golf club, comprising:

an elongated club head having a longitudinal channel;

a shaft having a lower end received in the channel;

spring means disposed in the channel for longitudinal motion therein, and means carried on the lower end of the shaft engagable with the spring means such that the spring means urges the lower end of the shaft toward a restrained position in the channel; and means in the club head for restraining longitudinal motion of the spring means in the channel, comprising:

a pair of weights disposed on opposite sides of the lower end of the shaft, the weights being slidably movable in the channel, and the spring means being so engaged with the weights and the shaft as to resiliently restrain motion of the shaft with respect to the club head.

13. A golf club, comprising:

an elongated club head having a longitudinal channel;

a shaft having a lower end received in the channel;

the shaft having a lower shaft member connected to the club head, an upper shaft member, a gripping element mounted on the upper shaft member, elongated sleeve means telescopically receiving the lower shaft member and the upper shaft member in a co-axial position, locking means for locking the lower shaft member and the upper shaft member at an adjusted combined length;

the sleeve means having a pair of end openings, the lower shaft member being disposed in one of the pair of the sleeve means openings, and the upper shaft member being disposed in the other of the pair of sleeve means openings;

spring means disposed in the channel for longitudinal motion therein, and means carried on the lower end of the shaft engagable with the spring means such that the spring means urges the lower end of the shaft toward a restrained position in the channel; and means in the club head for restraining longitudinal motion of the spring means in the channel.

14. A golf club as defined in claim 13, in which the restraining means includes a weight disposed in the channel, and the spring means comprises an elongated spring member having a first portion thereof for urging the lower end of the shaft toward a restrained position in the club head, and a second portion engaged with the weight to urge the weight toward a restrained position in the club head.

15. A golf club, comprising:

an elongated club head having a longitudinal channel;

a shaft having a lower end received in the channel;

spring means disposed in the channel for longitudinal motion therein, and means carried on the lower end of the shaft engagable with the spring means such that the spring means urges the lower end of the shaft toward a restrained position in the channel;

means in the club head for restraining longitudinal motion of the spring means in the channel comprising two weights disposed in the channel; and the spring means comprises an elongated spring member having a first portion thereof for urging the lower end of the shaft toward a restrained position in the club head, and a second portion engaged with the weight to urge the weight toward a restrained position in the club head.

* * * * *